US007803097B2

(12) United States Patent
Araujo

(10) Patent No.: US 7,803,097 B2
(45) Date of Patent: Sep. 28, 2010

(54) EXERCISE APPARATUS FOR STRENGTHENING ABDOMINAL MUSCLES

(76) Inventor: William Araujo, 1708 Forest Haven Blvd., Edison, NJ (US) 08817

( * ) Notice: Subject to any disclaimer, the term of this patent is extended or adjusted under 35 U.S.C. 154(b) by 151 days.

(21) Appl. No.: 11/609,977

(22) Filed: Dec. 13, 2006

(65) Prior Publication Data

US 2007/0066463 A1 Mar. 22, 2007

Related U.S. Application Data

(60) Provisional application No. 60/743,087, filed on Jan. 1, 2006.

(51) Int. Cl.
*A63B 26/00* (2006.01)

(52) U.S. Cl. ..... 482/142

(58) Field of Classification Search ..... 482/23, 482/140, 907, 91, 24–29
See application file for complete search history.

(56) References Cited

U.S. PATENT DOCUMENTS 5,050,875 A * 9/1991 Lewkovich ..... 482/128
5,209,709 A * 5/1993 Eyman, Jr. ..... 482/30
5,346,447 A 9/1994 Stearns
5,352,173 A * 10/1994 McLaughlin ..... 482/123
6,053,851 A * 4/2000 Tu ..... 482/122
6,110,078 A * 8/2000 Dyer ..... 482/79
6,270,446 B1 8/2001 Abelbeck
6,413,192 B2 7/2002 Abelbeck
6,491,608 B1 12/2002 Stearns
6,716,144 B1 * 4/2004 Shifferaw ..... 482/140
7,090,628 B2 8/2006 Badarneh

* cited by examiner

*Primary Examiner*—Lori Amerson
(74) *Attorney, Agent, or Firm*—Stanley H. Kremen

(57) ABSTRACT

An exercise apparatus that lies flat on the floor having a back rest rises up when supported by two springs. The lower part of the back and buttocks lie horizontal while the upper part of the back is inclined at an angle to the horizontal. When not in use, the upper back rest folds down flat so that the device can be stored under a bed. The two springs provide back support when the individual is in the reclining position. However, as a person goes from a sitting position to a reclining position, when his or her shoulders contact the back rest, the springs compress and then expand to assist the individual in rising up. The device has two specially designed positionable foot rests with straps to provide a place for the individual to place his or her feet.

21 Claims, 4 Drawing Sheets

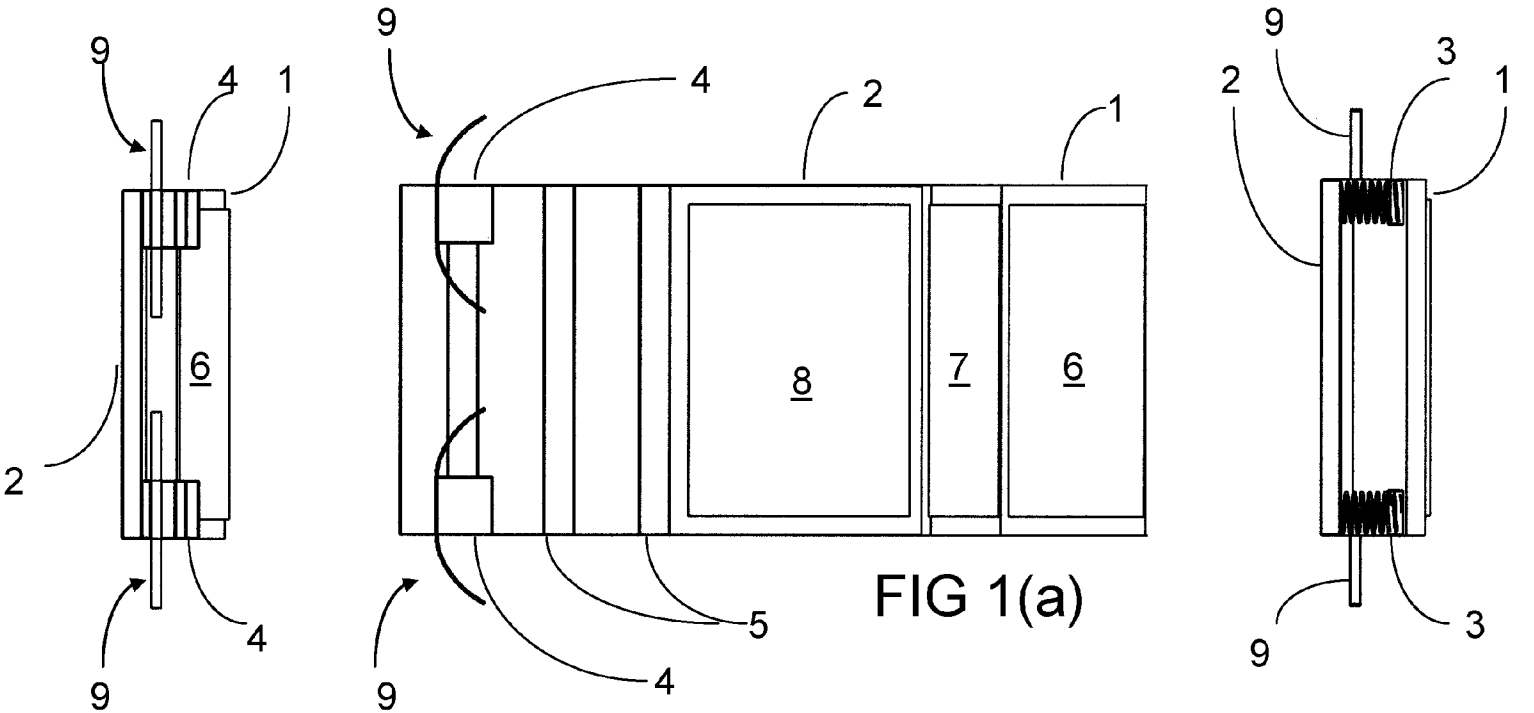
FIG 1(a)
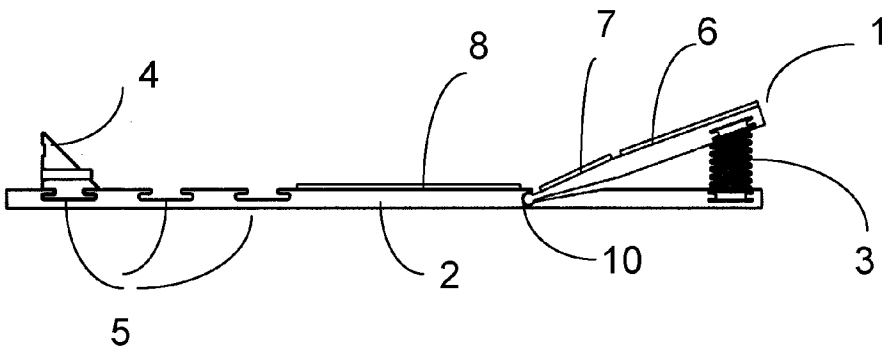
FIG 1(b)
FIG 1(c)
FIG 1(d)

FIG. 4(b)
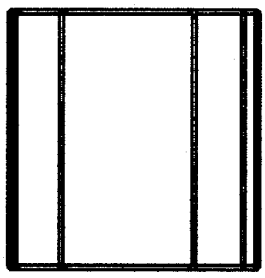
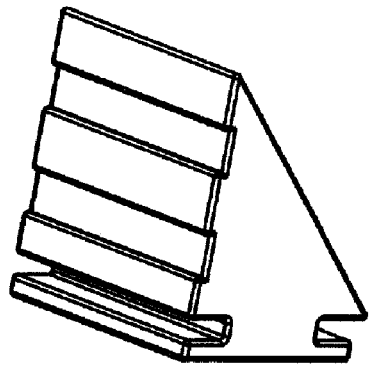
FIG. 4(c)
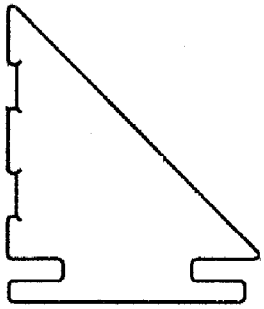
FIG. 4(a)

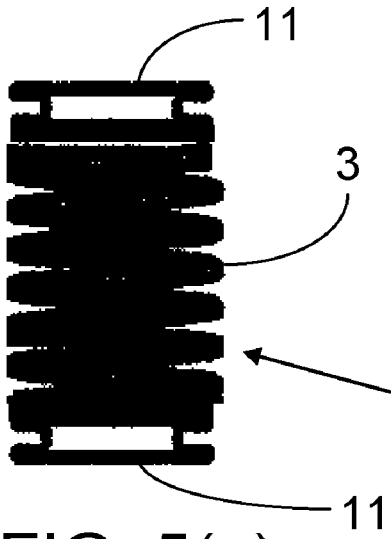
FIG. 5(a)
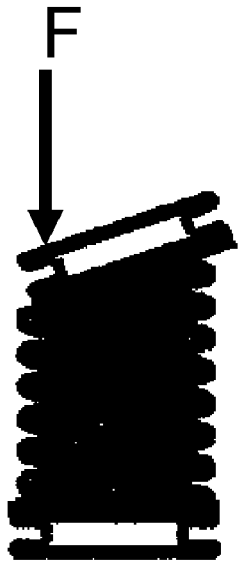
FIG. 5(b)
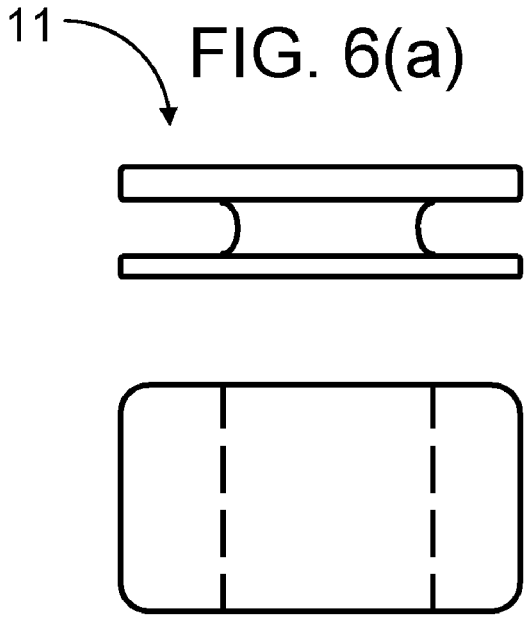
FIG. 6(a)
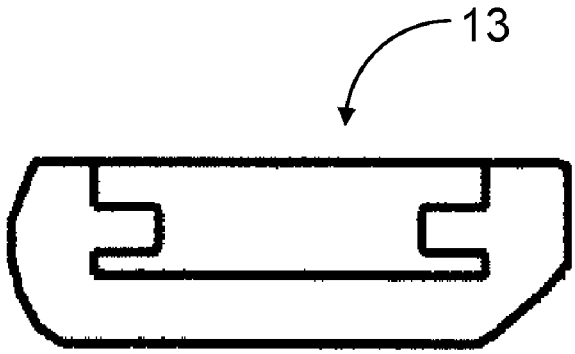
FIG. 6(c)
FIG. 6(b)
11

EXERCISE APPARATUS FOR STRENGTHENING ABDOMINAL MUSCLES

CROSS REFERENCE TO RELATED APPLICATIONS

This Present Application is the non-provisional counterpart of U.S. Provisional Application Ser. No. 60/743,087 filed on Jan. 1, 2006. The Present Application claims the benefit of and priority to said Provisional Application which is incorporated by reference in its entirety herein.

BACKGROUND OF THE INVENTION

People today are more concerned with physical fitness than ever before. Doctors say that regular exercise is the key to living longer. Over the past few decades, gymnasium membership has skyrocketed. These places have many devices to aid individuals who want to exercise. The devices include treadmills, complex nautilus devices, rowing machines, stationary bicycles, etc. Most of this equipment is very expensive. People, in increasing numbers, are buying much less expensive devices for home use to enable them to keep fit.

The Present Invention is an exercise apparatus designed to aid people in doing sit-ups and stomach crunches. Most people who do these exercises lie on the floor. However, sit-ups performed from this position place undue strain on the neck, upper back, and shoulder muscles. A number of devices are sold commercially to assist people to do the sit-up and stomach crunch exercises. One such device is a canvas and aluminum chair that expands during the lying down part of the cycle, and bends during the sitting up part of the cycle. However this chair does not offer much resistance. So, while using it may feel good because exercising with it is easy, it does not do much to strengthen abdominal muscles. The adage is: "no pain . . . no gain!"

The disadvantages of the devices for this purpose that are currently on the market are:

they do not accommodate heavy or tall people;

they are limited to specific extensions;

they are not comfortable;

they do not offer resistance;

they do not assist in the exercise process.

SUMMARY OF THE INVENTION

The Present Invention is an exercise apparatus that lies flat on the floor. A back rest rises up when supported by two springs. The lower part of the back and buttocks lie horizontal while the upper part of the back is inclined at an angle to the horizontal. When not in use, the upper back rest folds down flat so that the device can be stored under a bed. Because of adjustable extensions, the device can accommodate a person who is anywhere between 4 feet to 7½ feet tall and who weighs anywhere between 90 lb. to 500 lb. The two springs provide back support when the individual is in the reclining position. However, as a person goes from a sitting position to a reclining position, when his or her shoulders contact the back rest, the springs compress and then expand to assist the individual in rising up. The device has two specially designed positionable foot rests with straps to provide a place for the individual to place his or her feet.

BRIEF DESCRIPTION OF THE DRAWINGS

FIG. 1(*a*) is a top elevational view of the Present Invention.

FIG. 1(*b*) is a right side plan view of the Present Invention. The device is symmetrical. Therefore, the left side plan view is similar to the right side view.

FIG. 1(*c*) is a front elevational view of the Present Invention.

FIG. 1(*d*) is a rear elevational view of the Present Invention.

FIG. 4(*a*) is a right side plan view of the foot rest.

FIG. 4(*b*) is a top plan view of the foot rest.

FIG. 4(*c*) is a right isometric view of the foot rest.

FIG. 5(*a*) is a front elevational view of the tabbed spring assembly.

FIG. 5(*b*) is a front elevational view of the tabbed spring assembly wherein a force is applied to its top left portion.

FIG. 6(*a*) is a front elevational view of the tab.

FIG. 6(*b*) is a bottom plan view of the tab.

FIG. 6(*c*) is a front elevational view of the slot.

DETAILED DESCRIPTION OF THE INVENTION

Figure 2:
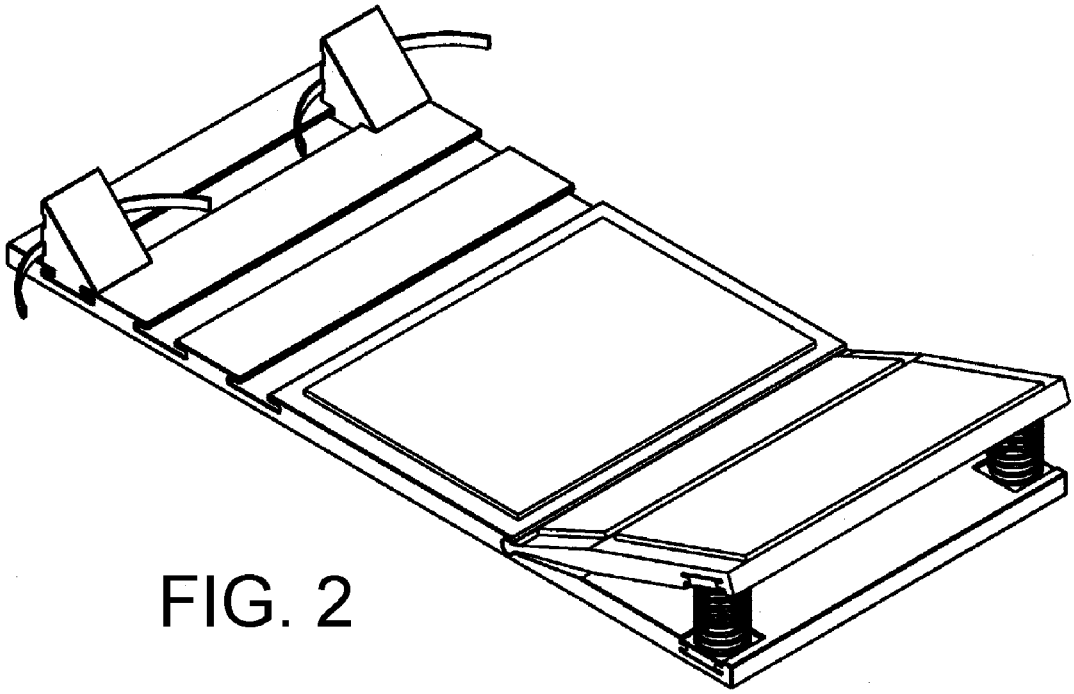
FIG. 2 is a rear isometric view of the Present Invention as seen from the right side.

Referring to FIG. 1, the apparatus of the Present Invention comprises a part that lies flat on the ground, 2, and a part that may incline, 1. The part that may incline is the upper back rest. The upper back rest is hinged to the rest of the device at 10. Removable springs 3 allow the upper back rest to remain in the inclined position. Removing the springs 3 permits the device to be stored flat. The device can be made from any durable material, but it is preferably formed from a hard plastic material. The upper back rest 1 would typically have two soft pads, 6 and 7, mounted thereon. Pad 6 supports the upper back, neck, and shoulders while pad 7 supports the middle of the back. Pad 6 should be thicker than pad 7, but this is optional. Pad 6 could also be thicker further toward the back of the device to provide head and neck support. Alternatively a pillow support, where a person can rest his head and neck, can be mounted on pad 6. The horizontal portion 2 has a soft pad 8 mounted thereon in the position shown. Pad 8 supports the lower back and buttocks. Also mounted to the horizontal portion 2 are two foot rests 4 each having strap 9. The foot rests fit adjustably into keyed grooves 5 located on the horizontal portion 2. The foot rests fit into any of the keyed grooves, and they may be moved from side to side. In this way, the foot rests may be adjusted to accommodate a range of leg sizes. Also, a user may work with both legs using both foot rests or, as an alternative, may optionally work with only one leg using only one foot rest.

Figure 3:
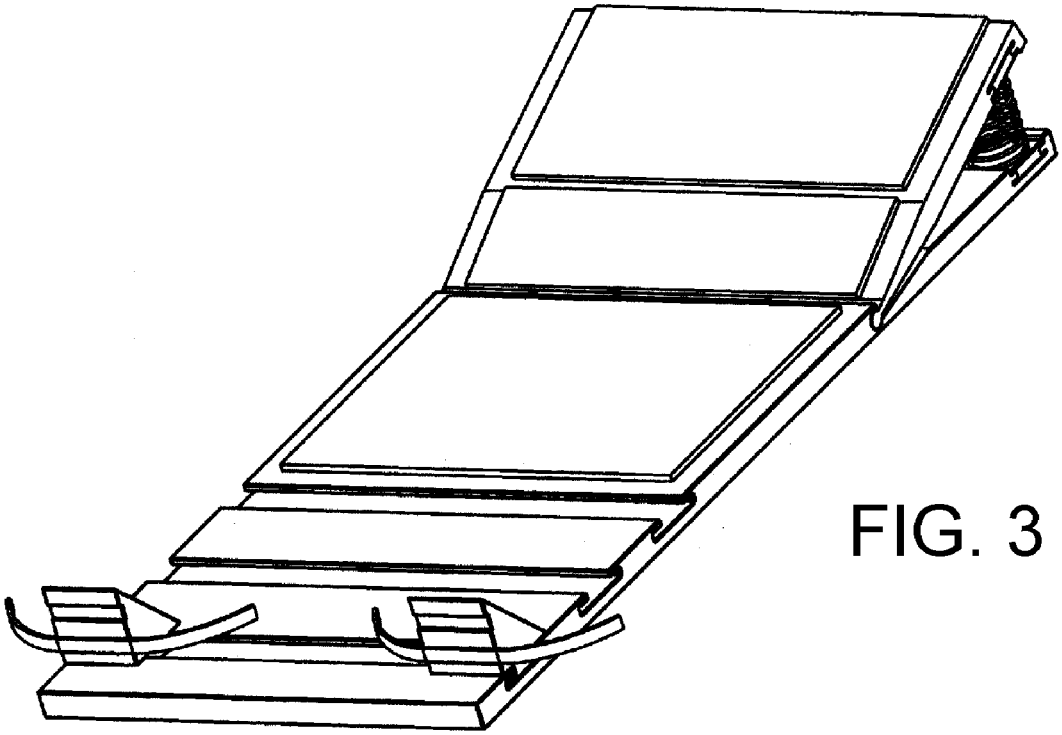
FIG. 3 is a front isometric view of the Present Invention as seen from the right side.

FIG. 2 and FIG. 3 are isometric views of the Present Invention. These views show the structure of the device more clearly. A typical spring would have eight active coils and four inactive coils. Each spring is capable of supporting 100 lbs. Therefore, the back support would be 200 lbs. Even a 500 lb. person would not have an inclined upper back weight exceeding 200 lbs. If fewer coils are used, the spring action is more elastic, and the springs provide greater assistance to the user on the up-cycle. On the other hand, if more coils are used, the spring action is more rigid. Here, the springs provide better back support.

FIG. 4 shows the foot rest. The foot rest is grooved and has a space or groove wherein a strap can be attached. FIG. 4(*c*) is an isometric view of the foot rest.

FIG. 5(*a*) shows the tabbed spring assembly 12 consisting of a spring 3 and two oppositely oriented tabs 11. FIG. 5(*b*) shows the spring assembly 12 as it compresses under uneven force.

FIG. 6(*a*) shows a front elevation view of the tab 11 used in the tabbed spring assembly 12. FIG. 6(*b*) is a bottom plan view of the plug 11. FIG. 6(*c*) is a front elevation view of the slot that the plug fits into.

I claim:

1. An exercise device to assist in the performance of abdominal crunches and exercises comprising:

a) a first board comprising a top face, a bottom face, and four edge faces, wherein said first board lays flat on a surface such that the bottom face contacts the surface;

b) a second board also comprising a top face, a bottom face, and four edge faces, wherein said board is attached to the first board by c) a hinge affixed to both the first and second boards, wherein said hinge is affixed to the first board at a distance between two of its edge faces and affixed to the second board at one of its edge faces, and wherein said hinge allows the second board to move freely in relation to the first board within a range of angles from parallel to perpendicular orientation and any angle in between; and, d) at least one spring connected to both the first board at its top face and the second board at its bottom face, said spring or springs providing resistance to a force that would move the second board towards a parallel orientation with respect to the first board by compressing the spring or springs;

wherein the first board has at least one slot into which a tabbed assembly is placed and firmly connected.

2. The exercise device of claim 1 wherein the surface is essentially horizontal.

3. The exercise device of claim 1 wherein the first board has a plurality of slots at different positions along the first board.

4. The exercise device of claim 1 wherein the second board has at least one slot into which a tabbed assembly is placed and firmly connected.

5. The exercise device of claim 1 wherein a pad is placed upon the first board.

6. The exercise device of claim 1 wherein a pad is placed upon the second board.

7. The exercise device of claim 1 wherein a single pad is placed upon both the first and second boards.

8. The exercise device of claim 1 wherein at least one spring is removable.

9. The exercise device of claim 4 wherein the tabbed assembly comprises at least one spring.

10. The exercise device of claim 9 wherein the tabbed assembly is connected to slots in both the first and second boards.

11. The exercise device of claim 1 wherein a foot rest is connected to the first board.

12. The exercise device of claim 11 wherein the foot rest is removable.

13. The exercise device of claim 1 wherein the tabbed assembly comprises a foot rest.

14. The exercise device of claim 13 wherein the tabbed assembly is removably positioned in a slot so as to place it closer to or farther away from the hinge joining the first and second board.

15. The exercise device of claim 11 wherein the tabbed assembly is adjustably positioned so as to place it closer to or farther away from the hinge joining the first and second board.

16. The exercise device of claim 11 wherein straps are attached to the foot rest to hold a foot in a fixed position thereon.

17. The exercise device of claim 1 wherein the second board, once moved towards a parallel orientation with respect to the first board, returns to an original position upon removal of the force.

18. The exercise device of claim 17 wherein, upon removal of the force, the spring or springs expand to exert an opposing force on the second board.

19. An exercise device to assist a person in the performance of abdominal crunches and exercises, wherein said person has buttocks and a back which further comprises an upper part and a lower part, said exercise device comprising:

a) a first member that supports the lower part of the back and the buttocks wherein said first member lays flat on a surface;

b) a second member that supports the upper part of the back wherein the second member is hinged to the first member; and, c) at least one removable spring having rigidity:

that when compressed by a force exerted by the person sitting or lying on the exercise device where said force tends to move the second member towards a position parallel to the first member or towards a position on the same plane as the first member, provides resistance to said compressive force, and that when the person is not sitting or lying on the exercise device or does not exert a force, said spring provides a compressive force that maintains the second member in a position not parallel to the first member and not in the same plane as the first member;

wherein the rigidity of the at least one removable spring is selectable so as to provide variable back support.

20. The exercise device of claim 19 wherein the rigidity of the at least one removable spring is selected by varying the number of coils.

21. The exercise device of claim 19 comprising two removable springs.

* * * * *